US008678215B2

(12) United States Patent
Steiger et al.

(10) Patent No.: US 8,678,215 B2
(45) Date of Patent: Mar. 25, 2014

(54) CONTAINER HAVING IMPROVED POURING CHARACTERISTICS

(75) Inventors: John Steiger, Glenview, IL (US); Machelle D. Stockwell, Cary, IL (US)

(73) Assignee: Tropicana Products, Inc., Bradenton, FL (US)

( * ) Notice: Subject to any disclaimer, the term of this patent is extended or adjusted under 35 U.S.C. 154(b) by 911 days.

(21) Appl. No.: 11/842,670

(22) Filed: Aug. 21, 2007

(65) Prior Publication Data

US 2008/0078765 A1 Apr. 3, 2008

Related U.S. Application Data

(60) Provisional application No. 60/839,351, filed on Aug. 21, 2006.

(51) Int. Cl.
*B65D 23/10* (2006.01)

(52) U.S. Cl.
USPC ..... 215/398; 215/382; 220/771; 222/468

(58) Field of Classification Search
USPC ..... 220/669, 771; 215/396, 382, 398; 222/557, 468
See application file for complete search history.

(56) References Cited

U.S. PATENT DOCUMENTS

| | | | | | |
|---|---|---|---|---|---|
| 308,106 | A | * | 11/1884 | Stimpson | 222/468 |
| 591,735 | A | * | 10/1897 | Brewer | 222/468 |
| 2,978,131 | A | * | 4/1961 | Garvey | 215/396 |
| 3,135,441 | A | * | 6/1964 | Wise et al. | 222/541.9 |
| 3,214,052 | A | * | 10/1965 | Dike | 215/10 |
| 3,251,514 | A | * | 5/1966 | Speicher | 222/468 |
| 3,278,089 | A | * | 10/1966 | Heekin et al. | 222/153.07 |
| 3,282,477 | A | * | 11/1966 | Henchert | 222/541.9 |
| 3,396,875 | A | * | 8/1968 | Finch | 222/456 |
| 3,434,635 | A | * | 3/1969 | Mason, Jr. | 222/468 |
| 3,443,710 | A | * | 5/1969 | Hills | 215/385 |
| 4,127,206 | A | * | 11/1978 | Virog et al. | 215/385 |

(Continued)

FOREIGN PATENT DOCUMENTS

| | | |
|---|---|---|
| GB | 2377701 | 1/2003 |
| WO | 9961337 A2 | 12/1999 |
| WO | 0056612 | 9/2000 |

OTHER PUBLICATIONS

International Search Report, dated Jan. 3, 2008, PCT/US2007/076421.

(Continued)

*Primary Examiner* — Anthony Stashick
*Assistant Examiner* — Christopher McKinley
(74) *Attorney, Agent, or Firm* — Banner & Witcoff, Ltd.

(57) ABSTRACT

A container for containing a flowable substance includes a container body, a substantially elliptical opening in the container body, and a resealable closure affixed over the opening. The container body defines an internal cavity that is adapted to contain the flowable substance therein. The opening is adapted to allow the flowable substance to flow therethrough. The resealable closure is adjustable between an open position, where the flowable substance can flow through the opening, and a closed position, where the closure obstructs the opening to prevent the flowable substance from flowing through the opening. When the closure is in the open position and the container is substantially filled with the flowable substance, the flowable substance can flow through the opening without interrupting airflow through the opening when the container is tilted over a range of tilt angles of approximately 35 degrees.

21 Claims, 9 Drawing Sheets

(56) References Cited

U.S. PATENT DOCUMENTS

| | | | | | |
|---|---|---|---|---|---|
| 4,269,722 | A | * | 5/1981 | Joshi et al. | 510/293 |
| 4,412,633 | A | * | 11/1983 | Guerrazzi et al. | 222/468 |
| D279,453 | S | * | 7/1985 | Beechuk et al. | D9/520 |
| 4,804,119 | A | * | 2/1989 | Goodall | 222/468 |
| 4,815,618 | A | * | 3/1989 | Gach | 215/232 |
| D305,407 | S | * | 1/1990 | Gonda | D9/528 |
| 4,901,892 | A | | 2/1990 | Song | |
| 4,934,590 | A | * | 6/1990 | Robichaud et al. | 229/125.09 |
| 4,998,674 | A | * | 3/1991 | Torra | 239/652 |
| D323,456 | S | * | 1/1992 | Gonda | D9/527 |
| 5,101,999 | A | * | 4/1992 | Robichaud et al. | 220/258.4 |
| 5,340,000 | A | * | 8/1994 | Ring | 222/468 |
| 5,346,106 | A | * | 9/1994 | Ring | 222/465.1 |
| 5,484,101 | A | * | 1/1996 | Hedberg | 229/125.04 |
| 5,794,824 | A | * | 8/1998 | Jeong | 222/468 |
| 5,875,958 | A | * | 3/1999 | Weiteder et al. | 229/125.15 |
| 6,029,858 | A | * | 2/2000 | Srokose et al. | 222/143 |
| 6,044,997 | A | * | 4/2000 | Ogg | 215/381 |
| 6,068,161 | A | * | 5/2000 | Soehnlen et al. | 222/143 |
| 6,196,425 | B1 | * | 3/2001 | Fielding et al. | 222/468 |
| 6,302,608 | B1 | * | 10/2001 | Holmes et al. | 401/125 |
| 6,360,924 | B1 | * | 3/2002 | Franzen | 222/468 |
| 6,382,475 | B1 | * | 5/2002 | Weikinger | 222/479 |
| 6,419,101 | B1 | * | 7/2002 | Hessel et al. | 215/253 |
| 6,520,387 | B2 | * | 2/2003 | Soehnlen et al. | 222/552 |
| 6,591,986 | B2 | * | 7/2003 | Soehnlen et al. | 206/434 |
| 6,877,630 | B2 | | 4/2005 | von Spreckelsen et al. | |
| 6,964,359 | B1 | * | 11/2005 | Darr et al. | 222/570 |
| 6,994,233 | B2 | * | 2/2006 | Dygert et al. | 222/468 |
| 7,021,506 | B2 | * | 4/2006 | Soehnlen et al. | 222/552 |
| 7,086,548 | B2 | * | 8/2006 | Bartlett | 215/398 |
| 7,137,521 | B2 | * | 11/2006 | Yourist | 215/398 |
| 7,191,931 | B2 | * | 3/2007 | Damkjaer | 229/102 |
| 7,225,939 | B2 | * | 6/2007 | Casscles et al. | 215/398 |
| D547,997 | S | * | 8/2007 | Parcels | D7/319 |
| D576,875 | S | * | 9/2008 | Steiger et al. | D9/449 |
| 7,431,169 | B2 | * | 10/2008 | Ishikawa et al. | 215/396 |
| 7,959,044 | B1 | * | 6/2011 | Christian et al. | 222/468 |
| 2001/0054628 | A1 | * | 12/2001 | Harbaugh et al. | 222/479 |
| 2002/0084291 | A1 | * | 7/2002 | Kelley | 222/456 |
| 2003/0006210 | A1 | * | 1/2003 | Iizuka et al. | 215/398 |
| 2004/0040963 | A1 | * | 3/2004 | Arcati et al. | 220/269 |
| 2004/0211748 | A1 | * | 10/2004 | Bartlett | 215/398 |
| 2005/0072816 | A1 | | 4/2005 | von Spreckelsen et al. | |
| 2005/0205618 | A1 | * | 9/2005 | Mabee et al. | 222/541.9 |
| 2006/0289376 | A1 | | 12/2006 | von Spreckelsen et al. | |
| 2007/0095785 | A1 | * | 5/2007 | Ishikawa et al. | 215/398 |
| 2007/0290013 | A1 | * | 12/2007 | Yamane et al. | 222/547 |
| 2008/0078775 | A1 | * | 4/2008 | Steiger et al. | 220/810 |

OTHER PUBLICATIONS

International Preliminary Report on Patentability, dated Mar. 5, 2009, PCT/US2007/076421.

International Preliminary Report on Patentability, dated Mar. 5, 2009, PCT/US2007/076422.

International Search Report, dated Jan. 17, 2008, PCT/US2007/076422.

* cited by examiner

CONTAINER HAVING IMPROVED POURING CHARACTERISTICS

CROSS-REFERENCE TO RELATED APPLICATIONS

The present application claims priority to and the benefit of U.S. Provisional Application No. 60/839,351, filed on Aug. 21, 2006, which application is incorporated herein by reference and made a part hereof.

TECHNICAL FIELD

The invention relates to a container for holding a flowable substance, and more specifically, to a container having characteristics to enhance pouring of a flowable substance therefrom.

BACKGROUND OF THE INVENTION

It is known to make containers for liquid of plastics material, for example, high density polyethylene. Such containers may be closed by, for example, sealing the opening of the container with a cap, such as a threaded cap that screws onto a mouth of the container. While liquid containers are known, they often exhibit undesirable properties when pouring out the contents. As a flowable substance is poured from a container, a vacuum is created, drawing air into the container to replace the volume of the contents poured out. Typically, this airflow enters the container through the same opening through which the flowable substance is exiting the container. At a certain point, the flow of the flowable substance reaches a point where the substance exiting the container blocks or interrupts the air flow into the container, creating a phenomenon known as "glugging." Glugging often causes uneven and uncontrollable pouring, leading to splashing, spills, and other undesirable results. Existing containers typically do not exhibit satisfactory performance in enhancing a smooth, controllable flow of contents when poured and reducing glugging.

The present assembly is provided to solve the problems discussed above and other problems, and to provide advantages and aspects not provided by prior containers of this type. A full discussion of the features and advantages of the present invention is deferred to the following detailed description, which proceeds with reference to the accompanying drawings.

SUMMARY OF THE INVENTION

Aspects of the present invention relate to a container for containing a flowable substance that includes a container body, a substantially elliptical opening in the container body, and a resealable closure affixed over the opening. The container body defines an internal cavity that is adapted to contain the flowable substance therein. The opening is adapted to allow the flowable substance to flow therethrough. The resealable closure is adjustable between an open position, where the flowable substance can flow through the opening, and a closed position, where the closure obstructs the opening to prevent the flowable substance from flowing through the opening.

According to one aspect of the invention, when the closure is in the open position and the container is substantially filled with the flowable substance, the flowable substance can flow through the opening without interrupting airflow through the opening when the container is tilted over a range of tilt angles of at least 25 degrees, and in one embodiment, over a range of approximately 35 degrees.

According to other aspects of the invention, the container body has a concave area positioned adjacent to the opening and flat panels on opposed sides thereof. According to a further aspect, the container includes a handle adapted to be grasped by a user, and the handle is oriented in alignment with the major axis of the elliptical opening.

Additional aspects of the present invention relate to a container for containing a flowable substance that includes a container body, a non-circular opening in the container body, and a resealable closure affixed over the opening. The container body defines an internal cavity that is adapted to contain the flowable substance therein. The opening is adapted to allow the flowable substance to flow therethrough. The resealable closure is adjustable between an open position, where the flowable substance can flow through the opening, and a closed position, where the closure obstructs the opening to prevent the flowable substance from flowing through the opening. When the closure is in the open position and the container is substantially filled with the flowable substance, the flowable substance can flow through the opening without interrupting airflow through the opening when the container is tilted over a range of tilt angles of at least 25 degrees, and in one embodiment, over a range of approximately 35 degrees.

Further aspects of the present invention relate to a container for containing a flowable substance that includes a container body, an elongated opening in the container body, and a resealable closure affixed over the opening. The container body defines an internal cavity that is adapted to contain the flowable substance therein. The opening is adapted to allow the flowable substance to flow therethrough. The resealable closure is adjustable between an open position, where the flowable substance can flow through the opening, and a closed position, where the closure obstructs the opening to prevent the flowable substance from flowing through the opening. When the closure is in the open position and the container is substantially filled with the flowable substance, the flowable substance can flow through the opening without interrupting airflow through the opening when the container is tilted over a range of tilt angles of at least 25 degrees, and in one embodiment, over a range of approximately 35 degrees.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
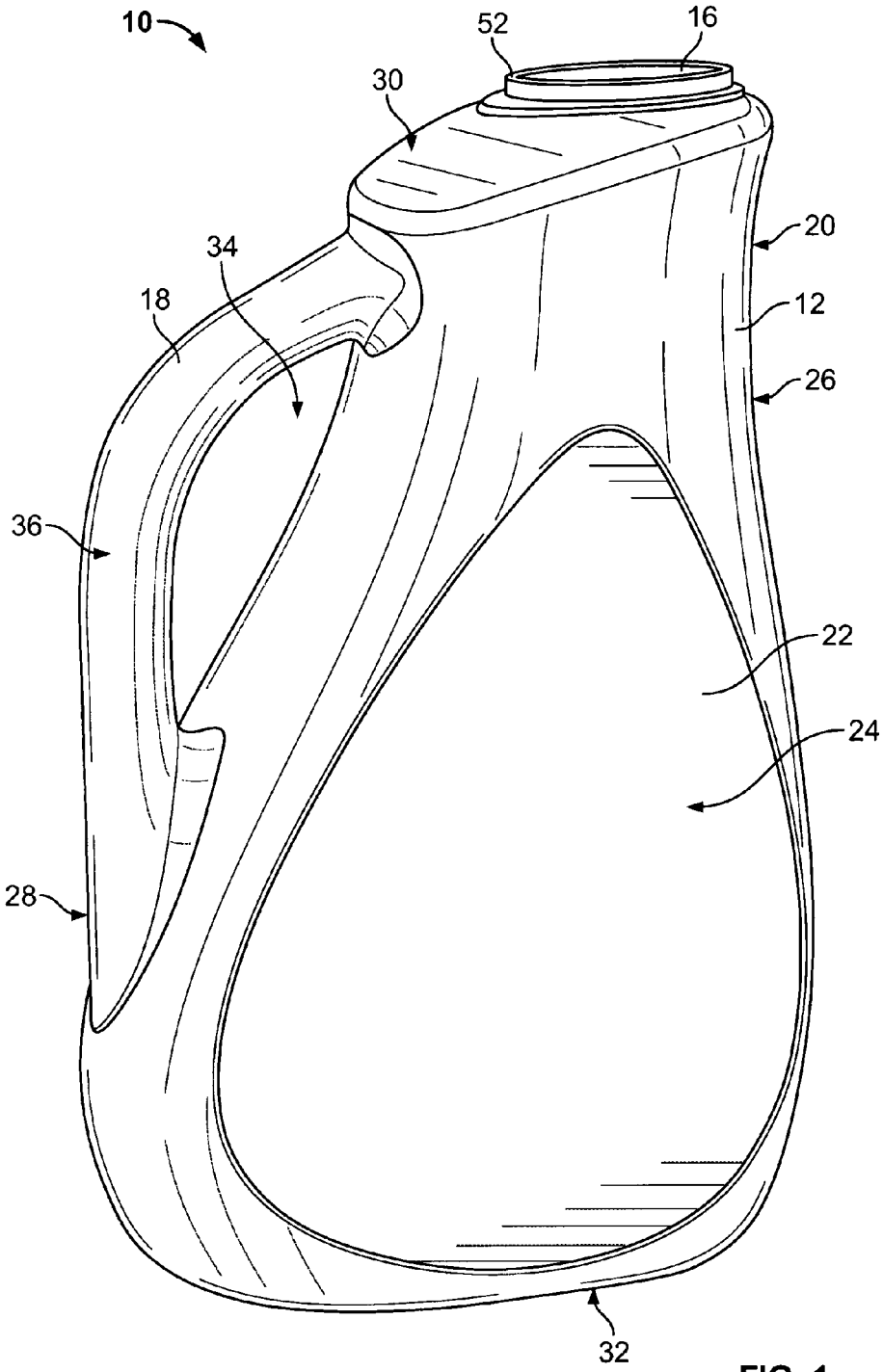
FIG. 1 is a rear perspective view of one embodiment of a container.
Figure 2:
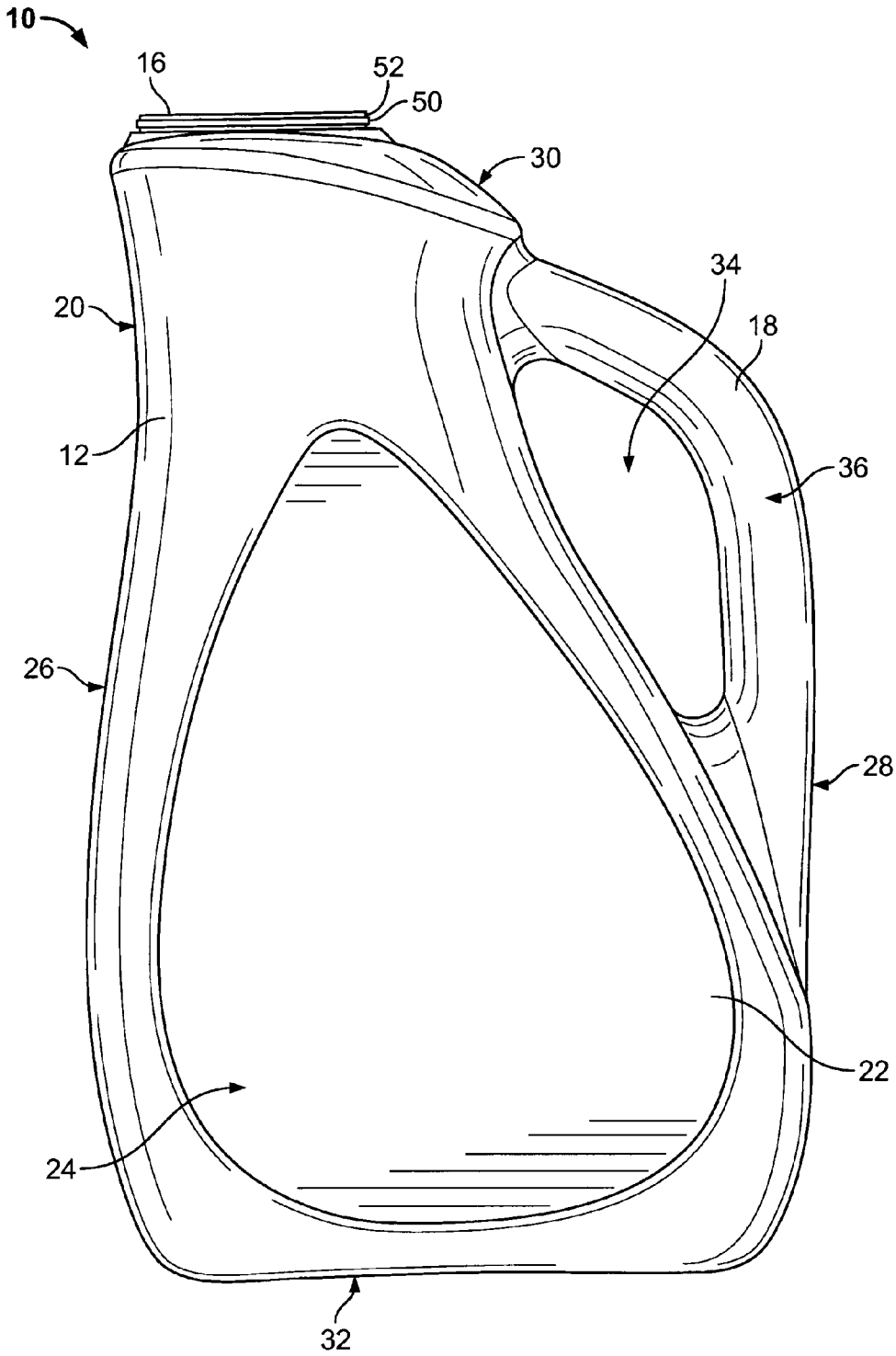
FIG. 2 is a side view of the container of FIG. 1.
Figure 3:
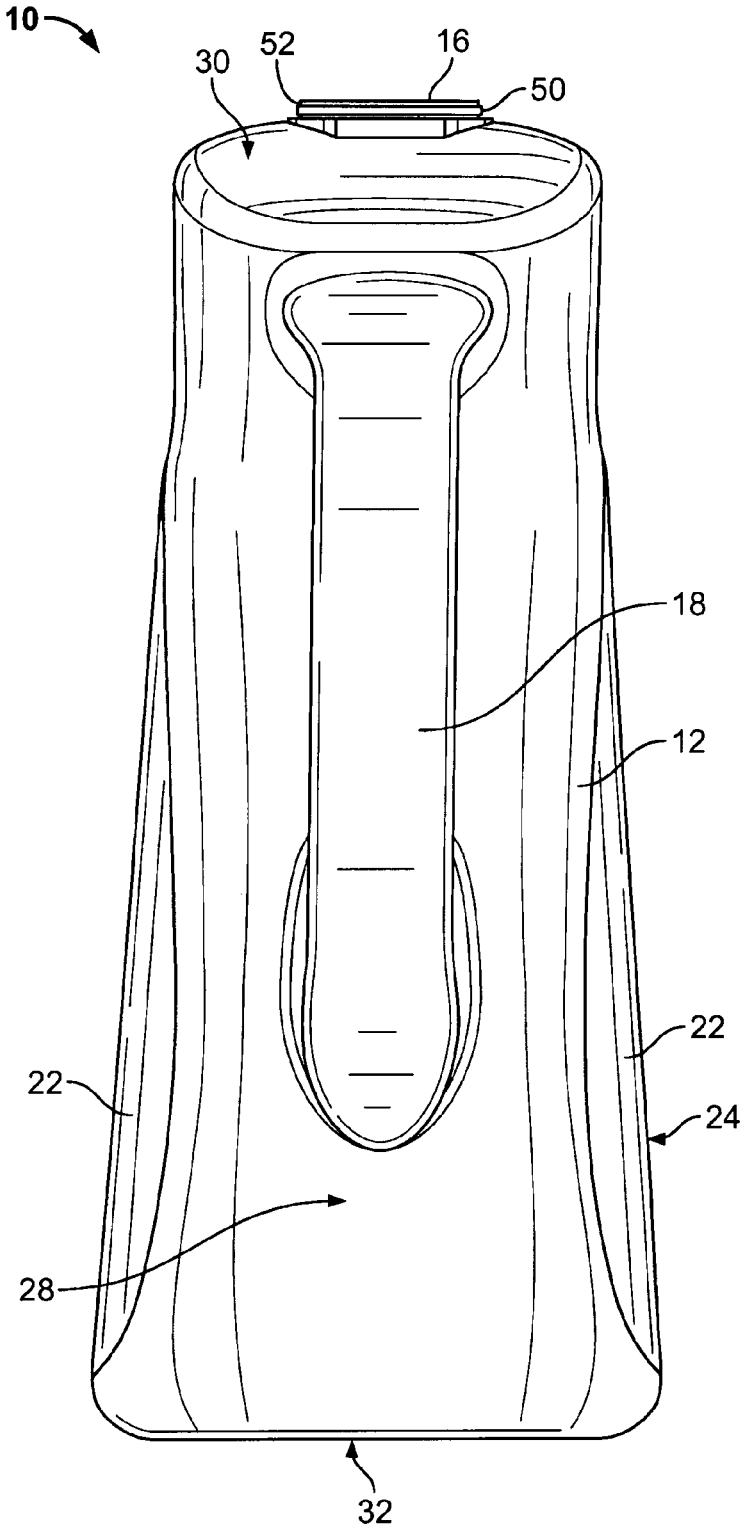
FIG. 3 is a rear view of the container of FIG. 1.
Figure 4:
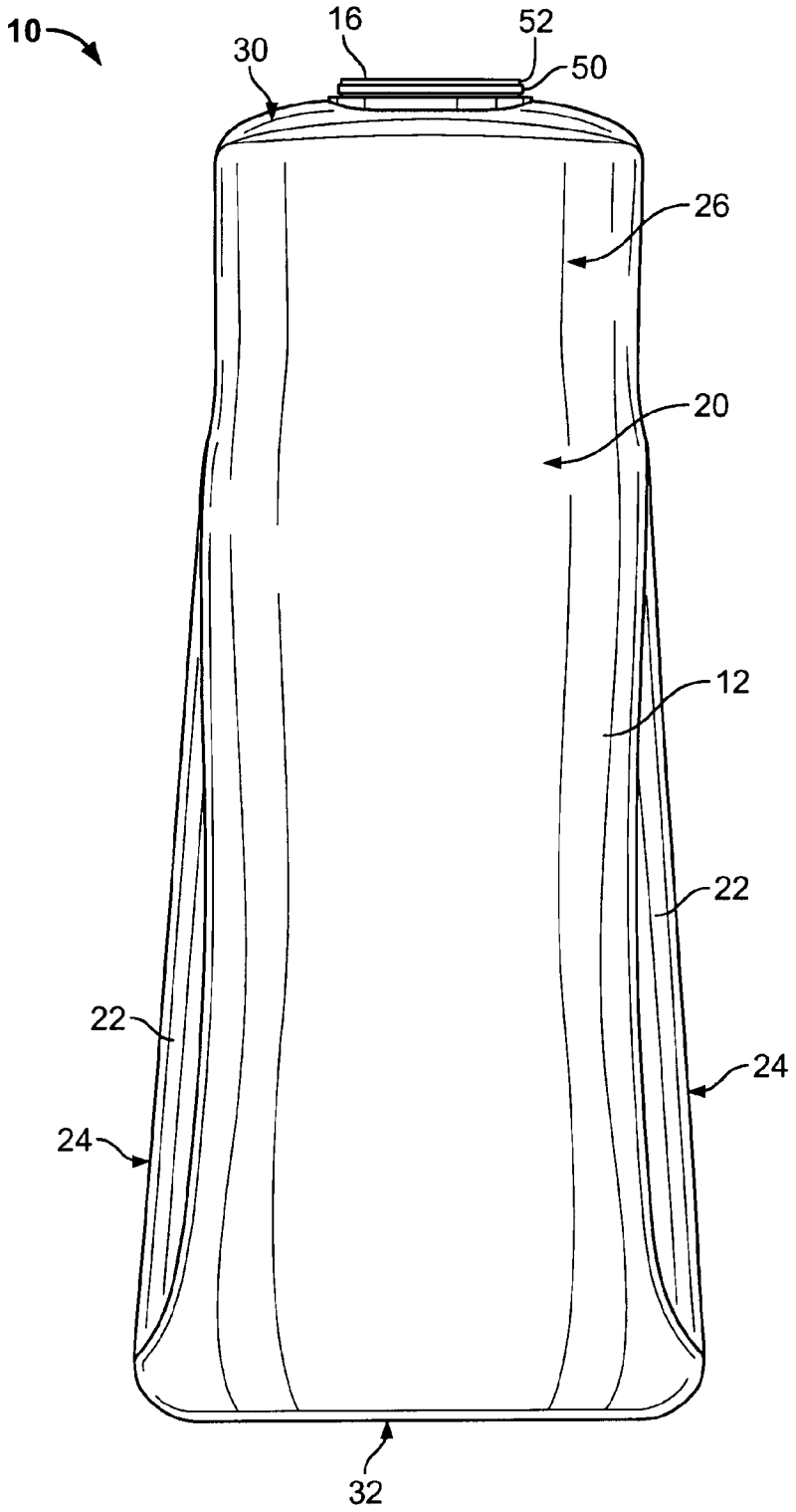
FIG. 4 is a front view of the container of FIG. 1.

While this invention is susceptible of embodiments in many different forms, exemplary embodiments of the invention are shown in the drawings and will herein be described in detail with the understanding that the present disclosure is to be considered as an exemplification of the principles of the invention and is not intended to limit the broad aspect of the invention to the embodiments illustrated.

Referring initially to FIGS. 1-6, an exemplary embodiment of a container 10 is shown that includes a container body 12 defining a cavity 14 therein, an opening 16, and a handle 18. The container 10 is adapted to contain a flowable substance therein, for example, a beverage or other liquid. The container body has a top 30, a bottom 32, a front 26, a back 28, and opposed sides 24. The container body 12 further has a concave area 20 on the front 26 of the container 10 near the opening 16 and substantially flat panels 22 on opposed sides 24 of the container body 12. In the exemplary embodiment shown, the panels 22 are substantially planar and also substantially parallel to one another. In various embodiments, the planar areas may make up at least 40%, 50%, 60%, 70%, 80%, or 90% of the total area of the sides 24 of the container 10. Other embodiments may contain panels having a different configuration, or may not contain panels at all. The panels 22 may be used to provide a space for labeling of the container 10.

The container 10 may be manufactured from any suitable material known in the art of container production. In one exemplary embodiment, the container is made of high-density polyethylene in a blow-molding process. In other embodiments, the container may be made of a different polymer material, such as low-density polyethylene, polyethylene terephthalate, polypropylene, polyvinyl chloride, or polystyrene, or of a non-polymeric material, such as glass. Additionally, the container may be made using different techniques, which may be influenced by material choice.

In the embodiment shown in FIGS. 1-6, the handle 18 extends along the back 28 of the container 10 and has an aperture 34 to allow the a user to grasp the handle 18 by inserting the user's fingers into the aperture 34. Additionally, the handle 18 defines a hollow portion 36 that is contiguous with the internal cavity 14 of the container 10. The handle 18 is shaped and placed such that air entering the container opening 16 during pouring can enter the hollow portion 36 of the handle 18, assisting in smooth flow of the container contents during pouring. In other embodiments, the container 10 may have a handle formed by different structure, for example, by indentations in the sides 24 of the container 10, or may have no specifically designed handle.

The container 10 shown in FIGS. 1-6 has the concave area 20 on the front 26 of the container body 12. In some embodiments, the concave portion may be between one and five inches in height, and may be located from one to five inches from the top 30 of the container 10, or may be differently configured or located.

Figure 5:
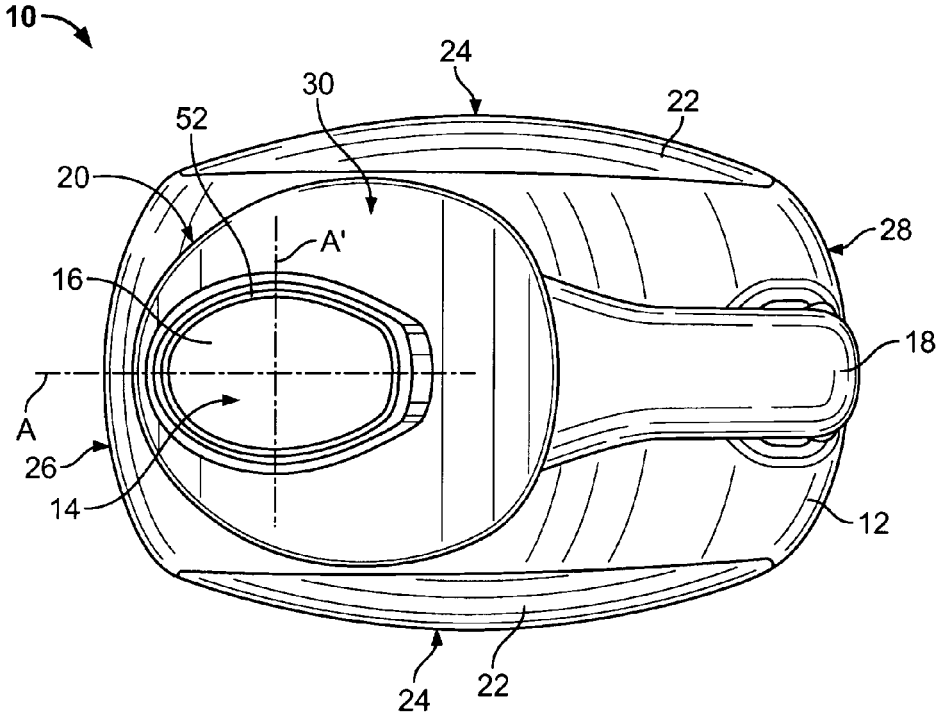
FIG. 5 is a top view of the container of FIG. 1.

As best illustrated in FIG. 5, the exemplary embodiment shown in FIGS. 1-6 has an elongated and non-circular opening that is substantially oval or elliptical in shape. As used herein, "elongated" means that the expanse of the opening is larger in one dimension (length or width) than in the other dimension. In the embodiment illustrated in FIG. 5, the opening 16 is oriented such that the longer dimension is oriented from the front 26 to the back 28 of the container 10, which is typically the direction the container 10 is oriented during pouring. As illustrated in FIG. 5, the opening 16 is elongated along an axis of elongation A, which is also referred to as a major axis for an elliptical or substantially elliptical opening. The minor axis A' of the substantially elliptical opening 16 is also depicted in FIG. 5. The handle 18 is aligned with and oriented along the same axis as the opening 16, i.e. the major axis or axis of elongation of the opening, in the exemplary embodiment shown. Additionally, in the embodiment shown, the axis A is generally aligned with a centerline and an axis of symmetry of the container. This orientation and alignment encourages tipping of the container in the general direction of the major axis or axis of elongation, which can enhance pouring performance, as discussed below.

In many applications, the container 10 includes a closure to cover the opening 16, preventing unwanted spilling of the contents, contamination, etc. In some embodiments, the container 10 may include a resealable closure to allow the container 10 to be selectively opened or closed. Examples of such closures include a snap-on closure, a flip-top closure, a plug closure, or many other types of resealable closures known in the art. In certain embodiments, the opening 16 may include a neck allowing for attachment of such a closure. Generally, such a resealable closure is adjustable between an open position, where the flowable substance can flow through the opening 16, and a closed position, where the closure obstructs the opening 16 to prevent the flowable substance from flowing therethrough.

Figure 6:
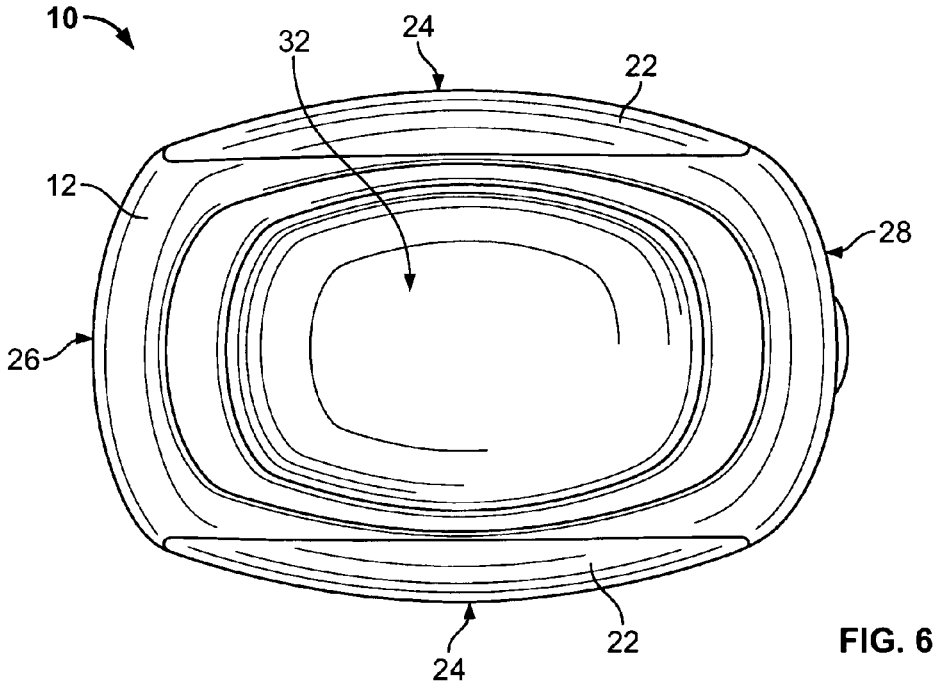
FIG. 6 is a bottom view of the container of FIG. 1.
Figure 7:
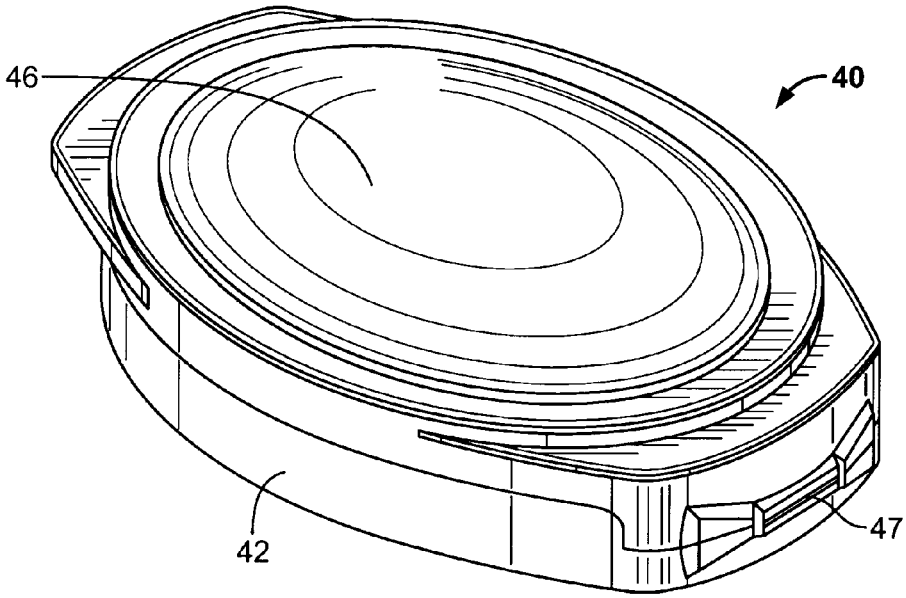
FIG. 7 is a rear perspective view of one embodiment of a closure suitable for use in with a container, such as the container of FIG. 1, shown in a closed position.
Figure 8:
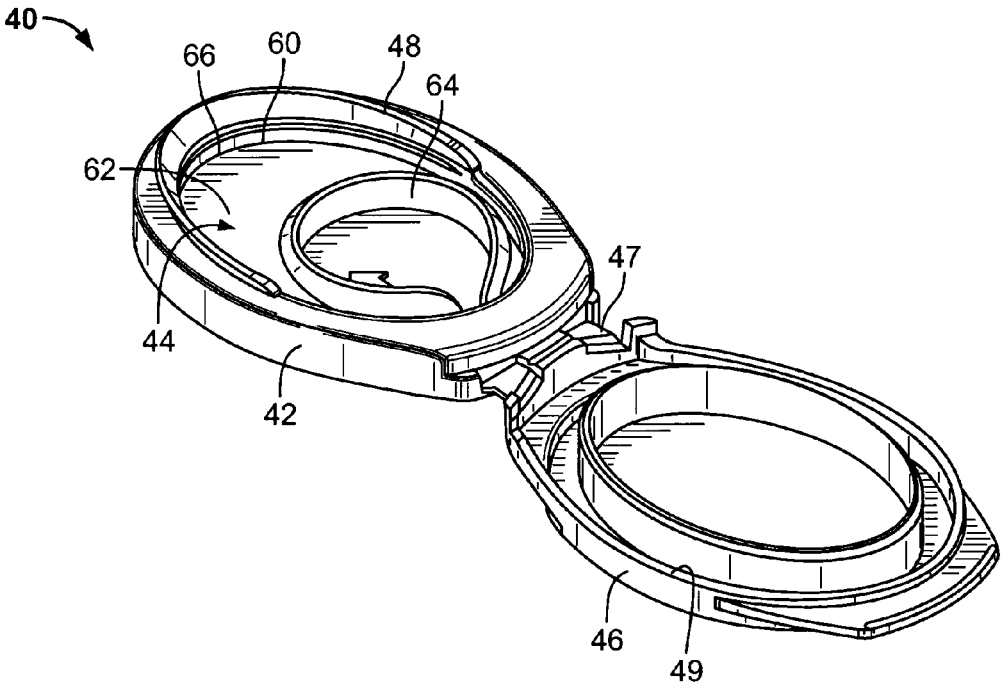
FIG. 8 is a rear perspective view of the closure of FIG. 7, shown in an open position while sealed.

FIGS. 7 and 8 illustrate one example of a flip-top closure 40 that is suitable for use with the container 10 illustrated in FIGS. 1-6. The closure 40 generally includes a base 42 having an aperture 44 therethrough and a hinged cap 46 pivotably connected to the base 42 by a hinge 47. Like the opening, the aperture 44 may also be elongated, non-circular, and/or substantially elliptical to accomplish enhanced pouring qualities. In the embodiment illustrated, the aperture 44 is shaped similarly to the opening 16 and is positioned in substantial alignment with the opening 16. In the embodiment illustrated, the shapes of the base 42 and cap 46 are also elongated, non-circular, and substantially elliptical. The hinged cap 46 is pivotable between a closed position (FIG. 7), where the cap 46 obstructs the opening 16, and an open position (FIG. 8), where the cap 46 does not obstruct the opening 16. The closure 40 also has a curved lip 48 positioned around a portion of the aperture 44, to minimize dripping during and after pouring. In the embodiment shown, the cap 46 is secured in the closed position by a pressure fit between the cap 46 and the base 42, formed by the lip 48 being received in a groove 49 in the cap 46. The closure 40 may be connected to the container 10 by snapping around the container opening 16, by interlocking with a bead 50 extending around at least a portion of the rim 52 of the opening 16. In other embodiments, the closure may be attached by other methods, such as gluing or spot welding, or may be formed integrally with the container 10.

The closure 40 illustrated in FIGS. 6 and 7 contains a membrane 60 to provide more secure sealing to the container 10, as well as a pull tab 62 having a pull ring 64 to assist in removal of the membrane 60. The membrane 60 is a polymercoated foil that is connected to the rim 52 of the opening 16, and is also connected to the underside of the base 42 of the closure 40 around the edge of the aperture 44, such as by heat sealing or gluing. The pull tab 62 is positioned within the aperture 44 and is connected to the base 42 around the periphery of the aperture 44 by a frangible portion 66 formed from a plurality of bridges 68 extending between the pull tab 62 and the base 42. These bridges 68 are not illustrated in FIGS. 6 and 7, but can be seen in detail in FIG. 11. The pull tab 62 is removed by a user exerting force on the pull ring 64, which causes the frangible portion 66 to break away. The membrane 60 is connected to the pull tab 62, so that when the pull tab 62 is removed from the closure 40, a portion of the membrane 60 tears away to unseal the opening 16 of the container.

Figure 9:
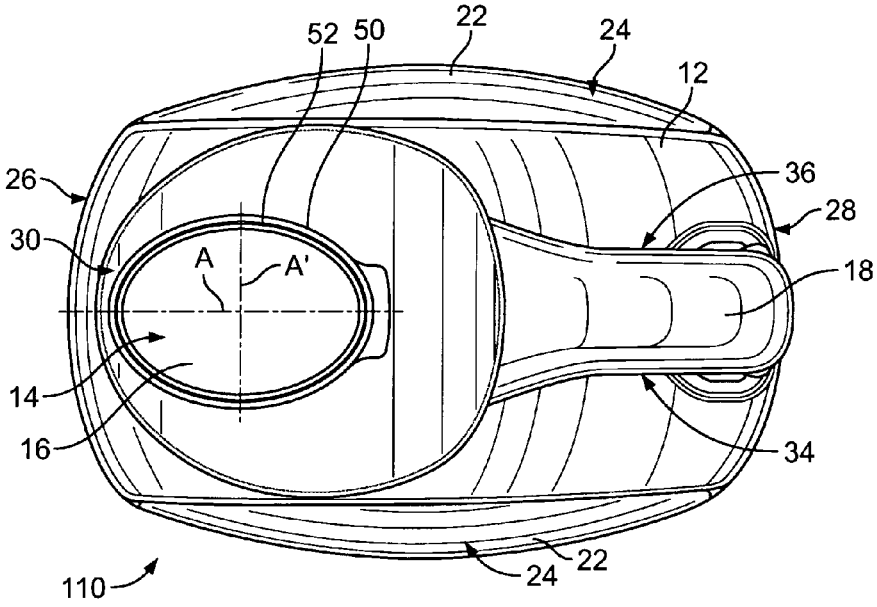
FIG. 9 is a top view of another embodiment of a container.

FIG. 9 illustrates another exemplary embodiment of a container 110. The container 110 of FIG. 9 contains features similar to those described above with respect to the container 10 of FIGS. 1-6, which are labeled with like reference numerals. One notable difference between the container 110 of FIG. 9 and the container 10 described previously is the shape of the opening 16. In the exemplary embodiment of the container 110 shown in FIG. 9, the opening 16 is more exactly elliptical than the opening 16 of the container 10 of FIGS. 1-6. Generally, other features of the containers 10, 110 illustrated are similar.

Figure 10:
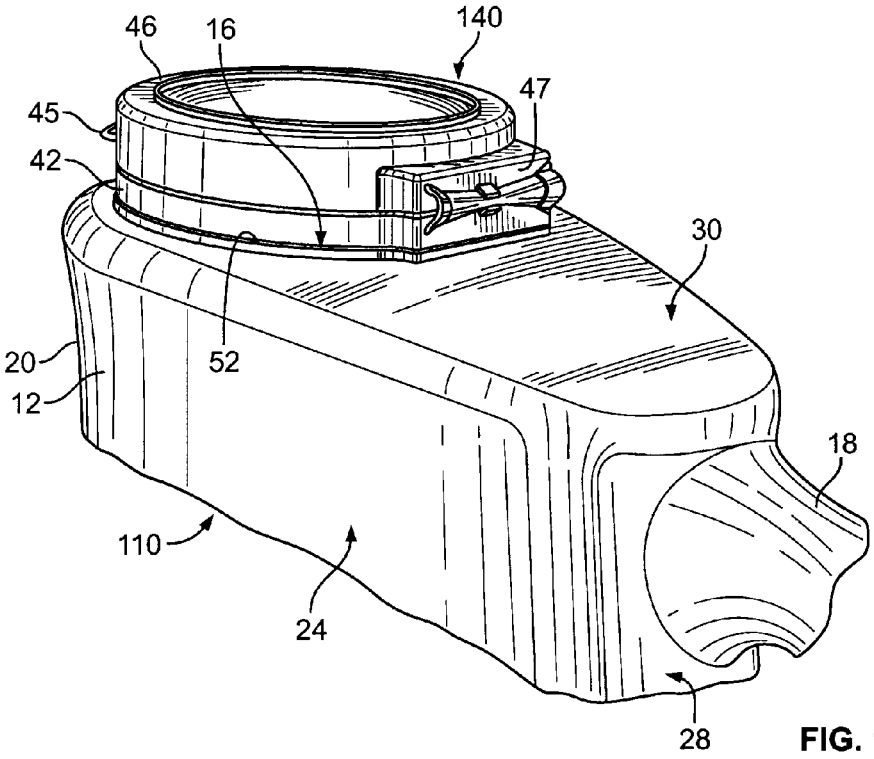
FIG. 10 is a rear perspective view of another embodiment of a closure connected to the container of FIG. 9, shown in a closed position.
Figure 11:
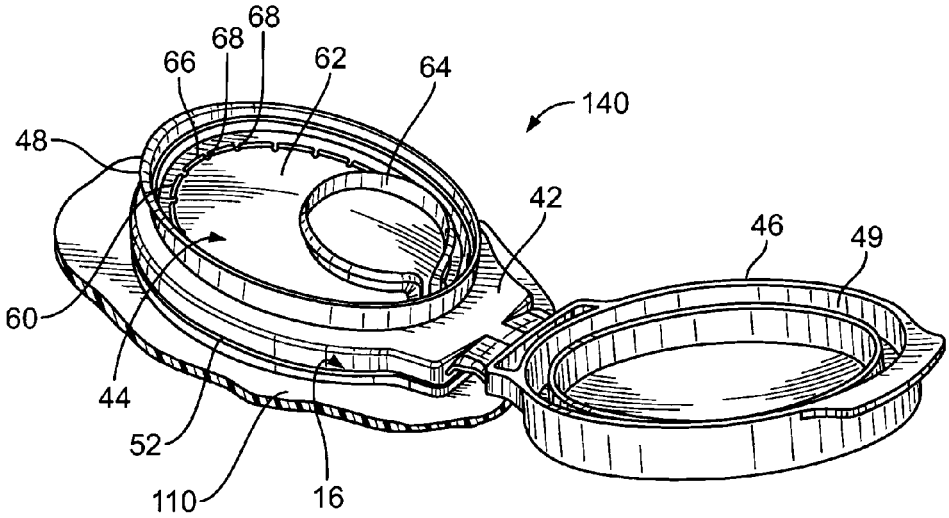
FIG. 11 is a rear perspective view of the closure of FIG. 10 connected to the container of FIG. 9, shown in an open position while sealed.
Figure 12:
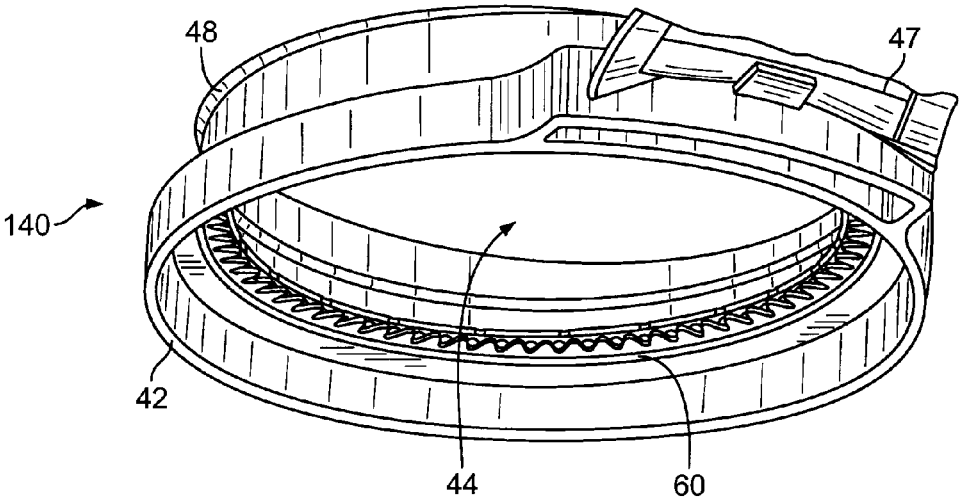
FIG. 12 is a partial bottom perspective view of the closure of FIG. 10, shown in an open position while unsealed.

FIGS. 10-12 illustrate another embodiment of a closure 140 that is suitable for use with the container 110 of FIG. 9. The closure 140 of FIGS. 10-12 contains features similar to those described above with respect to the closure 40 of FIGS. 7-8, which are labeled with like reference numerals. One notable difference between the closures 40, 140 is that the lip 48 of the closure 140 of FIGS. 10-12 extends completely around the periphery of the aperture 44. Additionally, the closure 140 of FIGS. 10-12 has a slightly different external shape and contour, to be compatible with the differently-shaped opening 16 of the container 110 of FIG. 9. Generally, other features of the closures 40, 140 illustrated are similar.

The features of the exemplary embodiments of the containers 10, 110 herein provide for improved rate and control of pouring of the flowable substance from the container 10, 110. The narrowed front 70 of the opening 16 provides for a slow initial pour, increasing control of pouring and decreasing spilling and splashing, particularly when the container 10 is tipped along the axis A during pouring. The elongated nature and orientation of the opening 16 permits increased airflow back through the rear 72 of the opening 16 during pouring without obstructing or interrupting such airflow, increasing maximum flow rate and reducing glugging during pouring. Reduced glugging also results in increased pouring control and reduced spilling and splashing.

Figure 13:
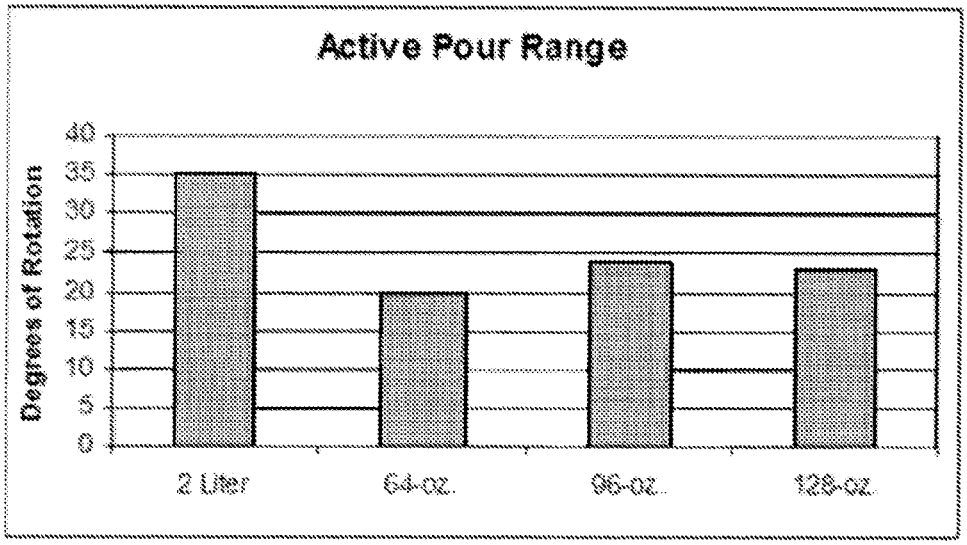
FIG. 13 is a chart showing active pour ranges for a number of different containers.

FIG. 13 illustrates the improved pouring provided by the containers 10, 110 described above. A container similar to the container 10 of FIG. 9, having a closure similar to the closure 140 of FIGS. 10-12 was substantially filled with a liquid. The container was tilted over a range of tilt angles to effect pouring of the liquid contents. The range of tilt angles was measured over which no glugging or interruption of airflow into the container was observed. These tilt angles were measured as the difference between the angle where the flowable substance began to flow through the opening and the angle where the flowable substance began glugging, resulting from interruption of airflow into the container. The same process was followed with an existing 64-oz paperboard carton with a circular opening and existing 96-oz and 128-oz plastic containers having circular openings. The measured results are illustrated in FIG. 13.

As illustrated by FIG. 13, the container 110 and closure 140 exhibited smooth pouring with no observable interruption of airflow into the container over a range of tilt angles of up to approximately 35 degrees from the initial pour. No other container tested exhibited such performance over a range of tilt angles of approximately 25 degrees or more. The container 110 having the substantially elliptical opening 16 and the closure 140 with the substantially elliptical aperture 44 exhibited an increase in pouring range of approximately 50% or more, compared to other containers tested, having circular openings. It is understood that different containers may exhibit different flow rates and pouring angles when the container is less than substantially full.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "length," "width," etc., as used herein, are intended for illustrative purposes only and do not limit the embodiments in any way. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A container comprising:

a container body defining an internal cavity adapted to contain a flowable substance therein;

a substantially elliptical opening in a top surface of the container body adapted to allow the flowable substance to flow therethrough;

a handle adapted to be grasped by a user, the handle comprising a first end at the container body, a tubular portion extending forwardly and upwardly from the first end toward the opening, and a second end connecting the tubular portion to the container body; and a resealable closure positioned over the opening, the closure comprising a base fixedly connected around the opening of the container to define an aperture positioned over the opening and a hinged cap connected to the base at a hinge located at a rear of the base, the cap being adjustable by pivoting about the hinge between an open position, wherein the flowable substance can flow from the internal cavity through the opening and the aperture, and a closed position, wherein the cap is releasably engaged with the base and obstructs the opening and the aperture to prevent the flowable substance from flowing through the opening, the closure further comprising a lip positioned around at least a portion of the aperture at a front of the base opposite the rear, wherein the lip extends upward from the base and is curved outwardly and away from a center of the aperture at the front of the base, and wherein a height of the lip increases to a maximum height at the front of the base, such that the maximum height of the lip at the front of the base is greater than the height of the lip at other locations,

[w]herein the opening has an elongated length, and the closure has a height defined from adjacent surfaces of the container, and wherein the adjacent surfaces of the container, the length of the opening, and the height of the closure are adapted such that when the closure is in the open position and the container is filled with the flowable substance to a level where pouring is possible at a tilt angle of approximately 25 degrees, the opening and the closure are adapted to permit the flowable substance to flow through the opening and the closure without interrupting airflow through the opening and the closure when the container is tilted over a range of tilt angles of greater than approximately 25 degrees wherein the second end of the handle is located below the top surface of the container and is spaced rearwardly from the opening, wherein the top surface of the container includes a sloped portion that is sloped rearwardly and downwardly away from the opening and extends from the opening to the second end of the handle, such that the sloped portion angles more sharply downward proximate the handle than proximate the opening.

2. The container of claim 1, wherein the adjacent surfaces of the container, the length of the opening, and the height of the closure are adapted such that when the closure is in the open position and the container is filled with the flowable substance to the level where pouring is possible at the tilt angle of approximately 25 degrees, the opening and the closure further adapted to permit the flowable substance to flow through the opening and the closure without interrupting airflow through the opening when the container is tilted over a range of tilt angles of approximately 35 degrees.

3. The container of claim 1, wherein the container body comprises a bottom, a top opposite the bottom and having the opening therein, a pair of opposed sides extending upward from the bottom to the top, and a front and a back extending from the bottom to the top and between the two sides, the front comprising a first portion extending upward from the bottom and having a convex contour, a second portion extending upward from the first portion and having a concave contour, and a third portion extending upward from the second portion to the top and having a convex contour, wherein the first, second, and third portions are continuous with each other.

4. The container of claim 1, wherein the substantially elliptical opening has a major axis and a minor axis, and wherein the handle is aligned with the major axis of the opening and oriented along the major axis of the opening.

5. The container of claim 1, wherein the container body has flat panels on opposed sides thereof.

6. A container comprising:

a container body defining an internal cavity adapted to contain a flowable substance therein, the container body comprising a bottom, a top opposite the bottom, a pair of opposed sides extending upward from the bottom to the top, and a front and a back extending from the bottom to the top and between the two sides, the front comprising a first portion extending upward from the bottom and having a convex contour, a second portion extending upward from the first portion and having a concave contour, and a third portion extending upward from the second portion to the top and having a convex contour, wherein the first, second, and third portions are continuous with each other;

an non-circular opening in the top of the container body adapted to allow the flowable substance to flow therethrough, the non-circular opening being elongated along an axis of elongation extending in the front-to-back direction relative to the container body;

a handle adapted to be grasped by a user, the handle comprising a first end at the container body, a tubular portion extending forwardly and upwardly from the first end toward the opening, and a second end connecting the tubular portion to the container body; and a resealable closure positioned over the opening, the closure being adjustable between an open position, wherein the flowable substance can flow through the opening, and a closed position, wherein the closure obstructs the opening to prevent the flowable substance from flowing through the opening, wherein the opening has an elongated length, and the closure has a height defined from adjacent surfaces of the container, and wherein the adjacent surfaces of the container, the length of the opening, and the height of the closure are adapted such that when the closure is in the open position and the container is substantially filled with the flowable substance, the opening and the closure are adapted to permit the flowable substance to flow through the opening and the closure without interrupting airflow through the opening and the closure when the container is tilted at a tilt angle of approximately 25 degrees, and wherein the second end of the handle is located below the top of the container and is spaced rearwardly from the opening, wherein the top of the container includes a sloped surface that is sloped rearwardly and downwardly away from the opening and extends from the opening to the second end of the handle, such that the closed more sharply downward proximate the handle than proximate the opening.

7. The container of claim 6, wherein the opening is substantially elliptical.

8. The container of claim 6, wherein the adjacent surfaces of the container, the length of the opening, and the height of the closure are adapted such that when the closure is in the open position and the container is substantially filled with the flowable substance, the opening and the closure are adapted to permit the flowable substance to flow through the opening and the closure without interrupting airflow through the opening and the closure when the container is tilted at a tilt angle of approximately 35 degrees.

9. The container of claim 6, wherein the tubular portion comprises a first arm extending upwardly away from the container body and a second arm extending from the first arm directly toward the opening to connect to the container body, wherein the container is adapted such that when the closure is in the open position, the container is substantially filled with the flowable substance, and the container is tilted at the tilt angle of approximately 25 degrees, airflow inward through the opening flows directly into the second arm of the handle without obstruction from the flowable substance.

10. The container of claim 6, wherein the handle is aligned with the axis of elongation of the opening and oriented along the axis of elongation of the opening.

11. The container of claim 6, wherein the container body has substantially flat panels on each of the opposed sides.

12. A container comprising:

a container body defining an internal cavity adapted to contain a flowable substance therein, the container body comprising a bottom, a top opposite the bottom, a pair of opposed sides extending upward from the bottom to the top, and a front and a back extending from the bottom to the top and between the two sides, the front comprising a first portion extending upward from the bottom and having a convex contour, a second portion extending upward from the first portion and having a concave contour, and a third portion extending upward from the second portion to the top and having a convex contour, wherein the first, second, and third portions are continuous with each other;

an elongated opening in the top of the container body adapted to allow the flowable substance to flow therethrough, the opening being elongated along an axis of elongation extending in the front-to-back direction relative to the container body;

a handle adapted to be grasped by a user, the handle comprising a first end at the container body, a tubular portion extending forwardly and upwardly from the first end toward the opening, and a second end connecting the tubular portion to the container body; and a resealable closure positioned over the opening, the closure being adjustable between an open position, wherein the flowable substance can flow through the opening, and a closed position, wherein the closure obstructs the opening to prevent the flowable substance from flowing through the opening, wherein the opening has an elongated length, and the closure has a height defined from adjacent surfaces of the container, and wherein the adjacent surfaces of the container, the length of the opening, and the height of the closure are adapted such that when the closure is in the open position and the container is filled with the flowable substance to a level where pouring is possible at a tilt angle of approximately 25 degrees, the opening and the container are adapted to permit the flowable substance to flow through the opening and the closure without interrupting airflow through the opening and the closure when the container is tilted over a range of tilt angles of greater than approximately 25 degrees, and wherein the second end of the handle is located below the top of the container and is spaced rearwardly from the opening, wherein the top of the container includes a sloped portion that is sloped rearwardly and downwardly away from the opening and extends from the opening to the second end of the handle, such that the sloped portion angles more sharply downward proximate the handle than proximate the opening.

13. The container of claim 12, wherein the opening is substantially elliptical.

14. The container of claim 12, wherein the adjacent surfaces of the container, the length of the opening, and the height of the closure are adapted such that when the closure is in the open position and the container is filled with the flowable substance to the level where pouring is possible at a tilt angle of approximately 25 degrees, the opening and the closure are adapted to permit the flowable substance to flow through the opening and the closure without interrupting airflow through the opening and the closure when the container is tilted over a range of tilt angles of approximately 35 degrees.

15. The container of claim 12, wherein the tubular portion comprises a first arm extending upwardly away from the container body and a second arm extending from the first arm directly toward the opening to connect to the container body, wherein the container is adapted such that when the closure is in the open position, the container is substantially filled with the flowable substance, and the container is tilted at the tilt angle of 25 degrees, airflow inward through the opening flows directly into the second arm of the handle without obstruction from the flowable substance.

16. The container of claim 12, wherein the handle is aligned with the axis of elongation of the opening and oriented along the axis of elongation of the opening.

17. The container of claim 12, wherein the container body has substantially flat panels on each of the opposed sides.

18. A container comprising:

a container body defining an internal cavity, the container body comprising a bottom, a top opposite the bottom, a pair of opposed sides extending upward from the bottom to the top and each having a substantially flat side panel thereon, and a front and a back extending from the bottom to the top and between the two sides, the front comprising a first portion extending upward from the bottom and having a convex contour, a second portion extending upward from the first portion and having a concave contour, and a third portion extending upward from the second portion to the top and having a convex contour, wherein the first, second, and third portions are continuous with each other;

a flowable substance contained within the internal cavity;

a substantially elliptical opening in the container body;

a handle adapted to be grasped by a user, the handle comprising a first end at the container body, a tubular portion extending forwardly and upwardly from the first end toward the opening, and a second end connecting the tubular portion to the container body; and a resealable closure positioned over the opening, the closure comprising a base fixedly connected around the opening of the container to define an aperture positioned over the opening and a hinged cap connected to the base at a hinge located at a rear of the base, the cap being adjustable by pivoting about the hinge between an open position, wherein the flowable substance can flow from the internal cavity through the opening and the aperture, and a closed position, wherein the closure obstructs the opening and the aperture and prevents the flowable substance from flowing through the opening, the closure further comprising a lip positioned around at least a portion of the aperture at a front of the base opposite the rear, wherein the lip extends upward from the base and is curved outwardly and away from a center of the aperture at the front of the base, and wherein a height of the lip increases to a maximum height at the front of the base, such that the maximum height of the lip at the front of the base is greater than the height of the lip at other locations, wherein the opening has an elongated length, and the closure has a height defined from adjacent surfaces of the container, and wherein the adjacent surfaces of the container, the length of the opening, and the height of the closure are adapted such that when the closure is in the open position and the container is filled with the flowable substance to a level where pouring is possible at a tilt angle of approximately 25 degrees, the flowable substance flows through the opening and the closure without interrupting airflow through the opening and the closure when the container is tilted over a range of tilt angles of greater than approximately 25 degrees, and wherein the second end of the handle is located below the top of the container and is spaced rearwardly from the opening, wherein the top of the container includes a sloped portion that is sloped rearwardly and downwardly away from the opening and extends from the opening to the second end of the handle, such that the sloped portion angles more sharply downward proximate the handle than proximate the opening.

19. The container of claim 18, wherein when the closure is in the open position and the container is filled with the flowable substance to the level where pouring is possible at a tilt angle of approximately 25 degrees, the flowable substance flows through the opening and the closure without interrupting airflow through the opening and the closure when the container is tilted over a range of tilt angles of approximately 35 degrees.

20. The container of claim 18, wherein the substantially elliptical opening has a major axis and a minor axis, and wherein the handle is aligned with the major axis of the opening and oriented along the major axis of the opening.

21. The container of claim 1, wherein the lip is further curved outwardly along sides of the aperture extending between the front and the rear.

* * * * *